United States Patent [19]

Dehne

[11] Patent Number: 4,640,196

[45] Date of Patent: Feb. 3, 1987

[54] TRACK MEMBER AND TRACK FOR CONVEYOR TROLLEYS

[75] Inventor: Clarence A. Dehne, Farmington Hills, Mich.

[73] Assignee: Jervis B. Webb Company, Farmington Hills, Mich.

[21] Appl. No.: 624,796

[22] Filed: Jun. 26, 1984

Related U.S. Application Data

[63] Continuation of Ser. No. 343,392, Jan. 28, 1982, abandoned.

[51] Int. Cl.[4] ..... B61B 12/02; B65G 39/00

[52] U.S. Cl. ..... 104/94; 198/838; 198/845; 104/109

[58] Field of Search ..... 198/687, 838, 845, 678; 104/94, 106, 107, 109, 172 B, 172 BT, 172 S

[56] References Cited

U.S. PATENT DOCUMENTS

| | | | |
|---|---|---|---|
| 3,043,408 | 7/1962 | Attwood | 104/107 |
| 3,407,751 | 10/1968 | Orwin | 104/172 BT |
| 4,122,778 | 10/1978 | Di Rosa | 198/678 |
| 4,405,042 | 9/1983 | Dehne | 198/687 |

FOREIGN PATENT DOCUMENTS

| | | | |
|---|---|---|---|
| 1035566 | 10/1953 | Fed. Rep. of Germany | 198/845 |
| 1658305 | 9/1970 | Fed. Rep. of Germany | 104/109 |
| 1282712 | 12/1961 | France | 198/678 |
| 639244 | 6/1950 | United Kingdom . | |
| 700649 | 12/1953 | United Kingdom | 198/678 |
| 896530 | 5/1962 | United Kingdom | 104/172 BT |
| 971331 | 9/1964 | United Kingdom | 104/172 S |

*Primary Examiner*—Robert J. Spar
*Assistant Examiner*—Daniel R. Alexander
*Attorney, Agent, or Firm*—Joseph W. Farley

[57] ABSTRACT

A track member for supporting the wheels of conveyor trolleys connected to a chain comprises first and second trackways arranged in vertically spaced, oppositely facing relation, each trackway having a pair of track surfaces spaced apart by a vertical web. The web of one trackway is longer than the other so that the first trackway is adapted to support trolley wheels of one diameter and the second trackway trolley wheels of another diameter. Various track constructions for overhead and floor type conveyors are obtainable by mounting pairs of the track members in transversely spaced parallel relation with either the first or second trackway of one member aligned with and facing the corresponding trackway of the other. In each of these track constructions the vertical webs of the non-facing trackways form parallel surfaces of a channel which laterally encloses and contains the chain.

10 Claims, 6 Drawing Figures

TRACK MEMBER AND TRACK FOR CONVEYOR TROLLEYS

This application is a continuation of U.S. patent application Ser. No. 343,392 filed on Jan. 28, 1982 and now abandoned.

This invention relates to an improved track member adapted to support the wheels of conveyor trolleys; and to an improved track consisting of a pair of the track members mounted in transversely spaced relation and adapted to support the wheels of conveyor trolleys connected to a longitudinally extending conveyor chain.

The invention provides a standardized versatile track member with a configuration which is usable in several ways to support conveyor trolleys having wheels of one diameter or conveyor trolleys having wheels of another diameter. Various track constructions are obtainable by employing a pair of the track members mounted in transversely spaced relation. These track constructions are usable with trolleys having wheels of one diameter or with trolleys having wheels of a different diameter and in conveyor systems having a conveyor chain connected to the trolleys either above or below their wheels. A pair of the track members is supportable either from above, as in an overhead type of conveyor system, or from below, as in a floor type of conveyor system.

A track member of the invention, adpated to vertically support the wheels of conveyor trolleys, comprises a first longitudinally extending trackway having a first vertical web and a first pair of longitudinal track surfaces extending transversely from the first vertical web in opposed vertically spaced relation; a second longitudinally extending trackway joined to the first trackway in vertically spaced oppositely facing relation, the second trackway including a second vertical web offset vertically and transversely with respect to the first vertical web, and a second pair of track surfaces extending transversely from the second vertical web in opposed vertically spaced relation; the lengths of the first and second webs being such that the track surfaces of the first trackway are adapted to be engaged by a trolley wheel of one diameter and the track surfaces of the second trackway are adapted to be engaged by a trolley wheel of another diameter.

Preferably, the track member is of integrally formed unitary construction and includes a transversely extending rib which connects the first and second vertical webs and which forms one of the track surfaces of the first and the second pairs of track surfaces; the vertical extremities of a track member are defined by first and second flanges which respectively extend transversely oppositely from the first and second vertical webs and which respectively form the other track surface of the first and second pairs of track surfaces; and, the first flange, the second flange and the transversely extending rib are contoured to provide work-hardened track surfaces.

The track of the invention is adapted to vertically support the wheels of conveyor trolleys connected to a longitudinally extending conveyor chain and comprises a pair of the track members described above together with mounting means which supports the pair of track members in longitudinally parallel relation with one of the trackways of one track member facing the corresponding trackway of the other track member in transversely spaced and aligned relation, and with the vertical webs of the other trackways of the track members in transversely spaced facing relation, the transversely spaced facing webs forming a channel which is adapted to laterally enclose and contain the conveyor chain.

A pair of the track members is supportable with either their first or second trackways in facing transverse alignment and the mounting means, which preferably comprises a plurality of longitudinally spaced yokes, can be arranged either above or below the pair of track members.

Other features and advantages will appear from the description to follow of the presently preferred embodiments of the invention shown in the accompanying drawings.

DESCRIPTION OF THE PREFERRED EMBODIMENT

Figure 1:
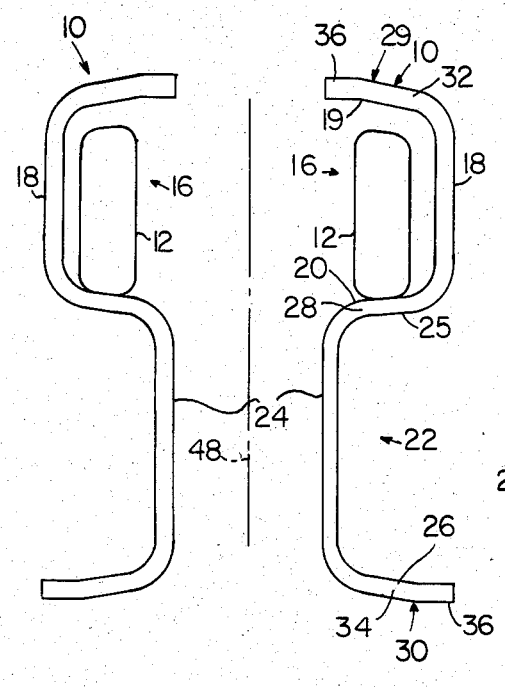
FIG. 1 is a transverse elevation illustrating a pair of track members of the invention arranged in one longitudinally parallel, transversely spaced relationship and supporting wheels of first conveyor trolleys having one diameter.
Figure 2:
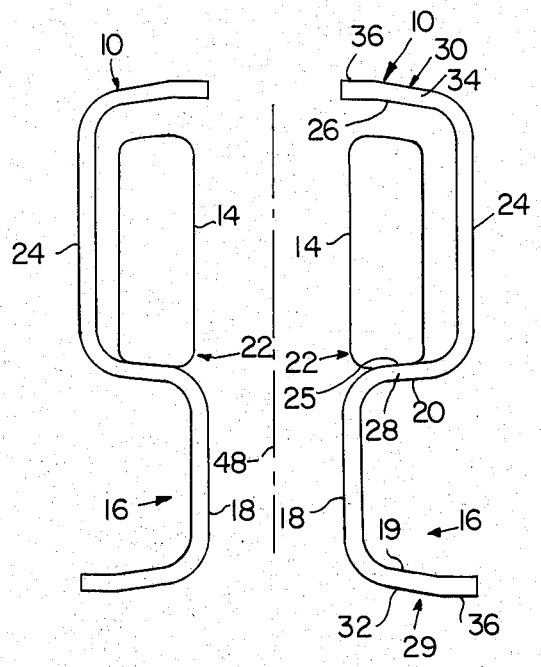
FIG. 2 is a transverse elevation illustrating a pair of track members of the invention arranged in a third longitudinally parallel, transversely spaced relationship and supporting trolley wheels of the diameter shown in FIG. 1A.
Figure 2A:
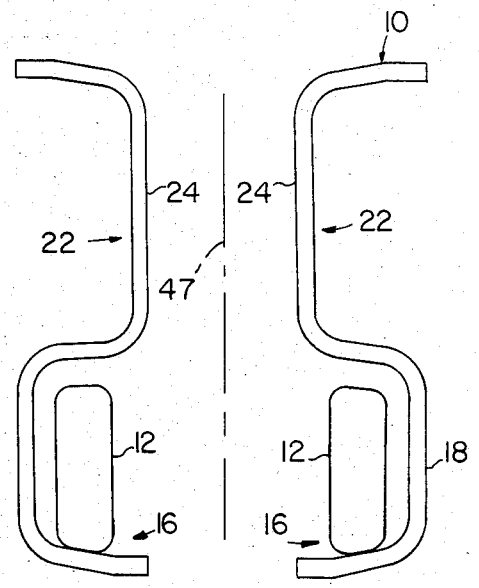
FIG. 2A is a transverse elevation illustrating of track members of the invention arranged in a fourth longitudinally parallel, transversely spaced relationship and supporting trolley wheels of the diameter shown in FIG. 1.
Figure 4:
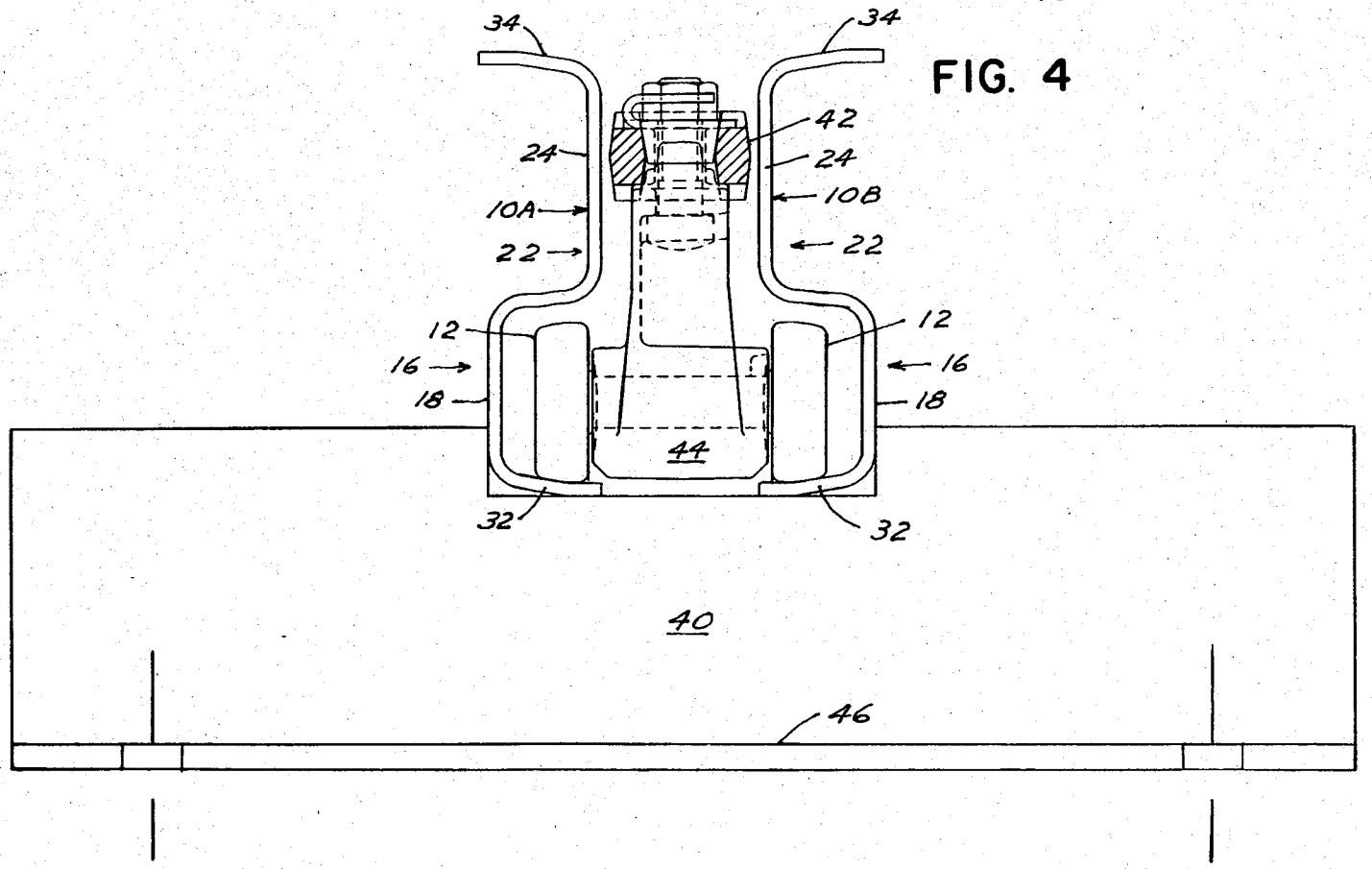
FIG. 4 is a transverse elevation of the track construction of FIG. 3, and showing the relationship between the track and a conveyor trolley connected to a conveyor chain.

FIGS. 1 through 2A illustrate the transverse configuration of a track member 10 of the invention and the various orientations in which this track member can be used to vertically support wheels 12 or 14 of conveyor trolleys, which orientations will be further explained after describing the track member 10 and the representative track construction of FIGS. 2 and 4.

The track member 10 comprises a first longitudinally extending trackway 16 having a first vertical web 18 and a first pair of track surfaces 19 and 20 which extend transversely from the web 18 in opposed, vertically spaced relation. A second longitudinally extending trackway 22 is joined to the first trackway 16 in vertically spaced, oppositely facing relation, and includes a second vertical web 24 offset vertically and transversely with respect to the first web 18. A second pair of track surfaces 25 and 26 extend transversely from the second web 24 in opposed vertically spaced relation. The length of the first vertical web 18 is such that the track surfaces 19 and 20 of the first trackway 16 are adapted to be engaged by the trolley wheel 12 of one diameter, while the length of the second vertical web 24 is such that the track surfaces 25 and 26 of the second trackway 22 are engageable by the trolley wheel 14 of another, larger diameter.

A transversely extending rib 28, located medially between the vertical extremities 29 and 30 of the track member 10, connects the first vertical web 18 with the second vertical web 24 and forms one track surface 20 of the first pair of track surfaces and one track surface 25 of the second pair. The other track surface 19 of the first pair and the other track surface 26 of the second pair is formed respectively by a first flange 32 and by a second flange 34. These first and second flanges 32 and 34 extend transversely and oppositely from the respective first and second vertical webs 18 and 24 and define the vertical extremities 29 and 30 of the track member.

The track member 10 having the foregoing configuration is preferably of integrally formed unitary construction, as shown, and is adapted to be economically fabricated by roll forming, or other technique, which enables the first flange 32, the second flange 34 and the transversely extending medial rib 28 to be contoured to provide work-hardened track surfaces which substantially conform to the peripheral contours of the trolley wheels they are adapted to engage.

Each of the first and second flanges 32 and 34 includes a terminal portion 36 which is disposed in substantially perpendicular relation to the respective first and second vertical web 18 and 24. The track surface 19 of the first flange 32 and the track surface 26 of the second flange 34 are each located between the terminal portion 36 and the respective one of the webs 18 and 24. Each of these track surfaces 19 and 26 is formed in obtuse angular relation to the terminal portion and the respective web to enhance the work-hardening of these track surfaces.

Figure 3:
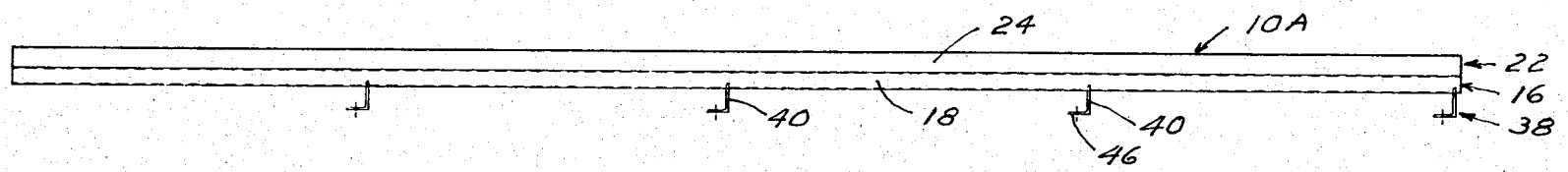
FIG. 3 is a side elevation of a representative track construction of the invention.

FIGS. 3 and 4 illustrate one of the various track constructions obtainable by employing a pair of the track members 10 for vertically supporting the wheels of conveyor trolleys connected to a longitudinally extending conveyor chain. This particular track construction employs a pair of the track members 10A and 10B and mounting means 38, in the form of a plurality of longitudinally spaced yokes 40, for supporting the track members 10A and 10B in a longitudinally parallel relation in which:

- the first trackway 16 of the track member 10A faces the corresponding first trackway 16 of the other track member 10B in transversely spaced and aligned relation; and
- the vertical webs 24 of the second trackways 22 of the track members 10A and 10B are positioned in transversely spaced facing relation and form a channel which laterally encloses and contains a conveyor chain 42 connected to conveyor trolleys 44.

As shown in FIG. 4, each yoke 40 is connected to the corresponding first flanges 32 and to a portion of the corresponding first vertical webs 18 of the track members 10A and 10B; and, the track members 10A and 10B are supported with their transversely spaced facing second webs 24 disposed vertically above the transversely aligned first trackways 16. This track construction is particularly suited for the trolleys and chain of a floor type of conveyor system and the yokes 40 are each provided with a horizontal lower flange 46 which can be attached to a floor or other structure.

Figure 1A:
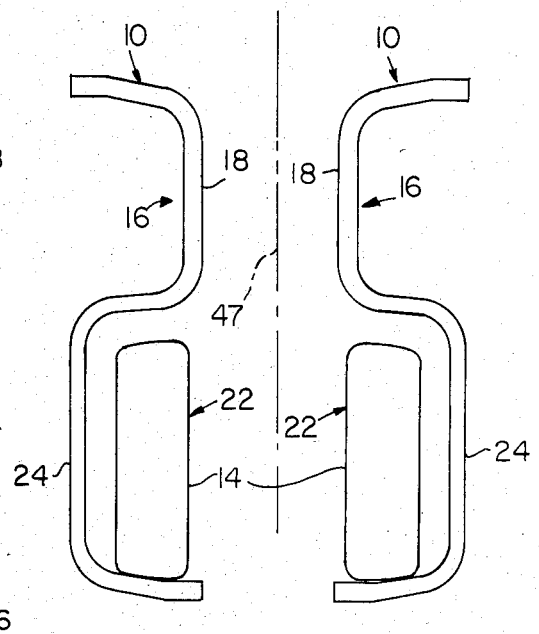
FIG. 1A is a transverse elevation illustrating a pair of track members of the invention arranged in a second longitudinally parallel, transversely spaced relationship and supporting wheels of second conveyor trolleys having another diameter.

It can be seen that the track of FIGS. 3 and 4 corresponds to the relationship of a pair of the track members 10 shown in FIG. 2A. A similar track for trolleys having the larger diameter wheels 14 is shown in FIG. 1A in which a pair of track members 10 is mounted symmetrically to the vertical track centerline 47 with the trackway 22 of one of the pair of track members 10 facing the corresponding trackway 22 of the other track members 10 and with the vertical webs 18 of the other trackways 16 facing each other. FIG. 1 illustrates a relationship of a pair of the track members 10 for trolleys having the wheels 12 of smaller diameter in which the mounting means supports the track members with their transversely spaced second vertical webs 24 disposed vertically below their transversely aligned facing first trackways 16 and in symmetrical relation to the vertical track centerline 48. The FIG. 1 relationship is suitable for overhead types of conveyor systems having the supporting yokes mounted above the track members, as illustrated by inverting FIG. 4. A similar overhead type of track for trolleys having the larger diameter wheels 14 is shown in FIG. 2.

In each of the various track constructions for overhead and floor type conveyor systems obtainable by employing the standardized track members 10, the conveyor chain 42 is enclosed within a channel defined either by a pair of vertical webs 18 or by a pair of vertical webs 24 (as in FIG. 4) of the track members. This chain channel protects the conveyor chain from contamination and damage and also contains the chain laterally so that relative movement between the chain components is substantially limited to the longitudinal direction. In some conveyor systems the chain channel provided by the invention can eliminate the need for a chain tensioning device or take-up. Any slack in the chain due to the absence of a take-up will be contained by the chain channel to relative longitudinal movement between the chain components.

Preferably, the track member 10 is fabricated from sheet metal by roll-forming operations which enable the pairs of track surfaces 19, 20 and 25, 26 to be accurately shaped and work hardened. The resulting track member has strength and surface finish characteristics superior to those of a comparable size beam of I or channel section such as commonly used for conveyor trolley tracks. These superior characteristics can also be obtained in a modified track member 10, roll formed with one of the first and second trackways 16 and 22 and with at least a portion of the vertical web 24 or 18 of the other of the trackways.

For example, this modified track member for the wheels 12 is formed with the longitudinally extending trackway 16 including the first vertical web 18 and the pair of track surfaces 19 and 20 which extend transversely from the vertical web 18 in opposed vertically spaced relation. Each of the track surfaces 19 and 20 is roll formed in obtuse angular relation to the first vertical web 18 to provide a smooth, work-hardened track surface adapted to be engaged by the trolley wheel 12 and to substantially conform to the contour thereof. A portion of the second vertical web 24 extends from the track surface 20, as a continuation of the rib 28, in vertically and transversely offset relation with the first vertical web 18 for any distance desired, thereby adding rigidity to the track surface 20 and forming a guide surface engageable by guide rollers of trolleys or by a conveyor chain as previously described.

What is claimed is:

1. A reversible and invertable track member adapted to form one-half of a track for vertically supporting the wheels of conveyor trolleys, said conveyor trolleys consisting of a plurality of first conveyor trolleys each having wheels of one diameter or consisting of a plurality of second conveyor trolleys each having wheels of another diameter, said track member comprising:

a first longitudinally extending trackway having a first vertical web and a first pair of longitudal track surfaces extending transversely from the first vertical web in opposed vertically spaced relation;

a second longitudinally extending trackway joined directly to the first trackway in vertically superimposed oppositely facing relation, the second trackway including a second vertical web offset vertically and transversely with respect to the first vertical web, and a second pair of track surfaces extending transversely from the second vertical web in opposed vertically spaced relation;

said first vertical web having a length such that said first pair of track surfaces are spaced apart a distance corresponding to the diameter of the wheels of said first trolleys, and said second vertical web having a length such that said second pair of track surfaces are spaced apart a distance corresponding to the diameter of the wheels of said second trolley wheels;

said track being formable by a pair of said track members assembled in any one of the following longitudinally parallel, transversely spaced relationships:

(a) the first trackways of said pair of track members face each other and form said track for the wheels of said first conveyor trolleys, and said second vertical webs of said pair of track members face each other and are disposed vertically below said track;

(b) the second trackways of said pair of track members face each other and form said track for the wheels of said second conveyor trolleys, and said first vertical webs of said pair of track members face each other and are disposed vertically below said track;

(c) the first trackways of said pair of track members face each other and form said track for the wheels of said first conveyor trolleys, and said second vertical webs of said pair of track members face each other and are disposed vertically above said track; and (d) the second trackways of said pair of track members face each other and form said track for the wheels of said second conveyor trolleys, and said first vertical webs of said pair of track members face each other and are disposed vertically above said track.

2. A track member according to claim 1 wherein one of the track surfaces of the first and second pairs of track surfaces is formed by a transversely extending rib connecting the first and second vertical webs.

3. A track member according to claim 2 wherein the other track surface of the first and second pairs of track surfaces is formed, respectively, by a first flange and a second flange, the first and second flanges extending transversely oppositely from the respective first and second vertical webs and defining the vertical extremities of the track member.

4. A track member according to claim 3 of integrally formed unitary construction.

5. A track member according to claim 3 or 4 wherein each of the first and second flanges includes a terminal portion disposed in substantially perpendicular relation to the respective vertical web, the track surface of the flange being located between the terminal portion and the respective vertical web and being formed in obtuse angular relation therewith to provide a work-hardened track surface adapted to be engaged by a trolley wheel and substantially conforming to the peripheral contour thereof.

6. A track member according to claim 3 or 4 wherein the first flange, the second flange and the transversely extending rib are contoured to provide work-hardened track surfaces.

7. A track including a pair of transversely spaced track members, conveyor trolleys having wheels engaging and vertically supported by said track members, and a longitudinally extending conveyor chain connected to said trolleys in vertically spaced relation to the wheels thereof, wherein;

said trolleys consist of a plurality of first trolleys or consist of a plurality of second trolleys, said first trolleys each having wheels of one diameter and said second trolleys each having wheels of another diameter;

each of said track members includes a first longitudinally extending trackway having a first vertical web and a first pair of longitudinal track surfaces extending transversely from the first vertical web in opposed vertically spaced relation; and a second longitudinally extending trackway joined directly to the first trackway in vertically superimposed oppositely facing relation, the second trackway including a second vertical web offset vertically and transversely with respect to the first vertical web, and a second pair of track surfaces extending transversely from the second vertical web in opposed vertically spaced relation;

said first vertical web having a length such that said first pair of track surfaces are spaced apart a distance corresponding to the diameter of the wheels of said first trolleys, and said second vertical web having a length such that said second pair of track surfaces are spaced apart a distance corresponding to the diameter of the wheels of said second trolley wheels;

and mounting means for supporting said pair of track members in a longitudinally parallel, transversely spaced relationship in which one of said first and second trackways of one of said track members faces the corresponding one of said first and second trackways of the other of said track members and in which the vertical webs of the other of said first and second trackways of said track members face each other, said facing trackways being unobstructed by said mounting means and forming said track engaged by and vertically supporting the wheels of one of said first or second trolleys and said facing webs forming a channel laterally enclosing and containing said conveyor chain; whereby said track members are capable of being assembled in any one of the following longitudinally parallel, transversely spaced relationships:

(a) said track is formed by said first trackways for the wheels of said first conveyor trolleys, said channel is formed by the vertical webs of said second trackways, and said channel is disposed vertically below said track;

(b) said track is formed by said second trackways for the wheels of said second conveyor trolleys, said channel is formed by the vertical webs of said first trackways, and said channel is disposed vertically below said track;

(c) said track is formed by said first trackways for the wheels of said first conveyor trollies, said channel is formed by the vertical webs of said second trackways, and said channel is disposed vertically above said track; and (d) said track is formed by said second trackways for the wheels of said second conveyor trolleys, said channel is formed by the vertical webs of said first trackways, and said channel is disposed vertically above said track.

8. A track including a pair of transversely spaced track members, and conveyor trolleys having wheels engaging and vertically supported by said track members, wherein;

said trolleys consist of a plurality of first trolleys or consist of a plurality of second trolleys, said first trolleys each having wheels of one diameter and said second trolleys each having wheels of another diameter;

each of said track members includes a first longitudinally extending trackway having a first vertical web and a first pair of longitudinal track surfaces extending transversely from the first vertical web in opposed vertically spaced relation; and a second longitudinally extending trackway joined directly to the first trackway in vertically superimposed oppositely facing relation, the second trackway including a second vertical web offset vertically and transversely with respect to the first vertical web, and a second pair of track surfaces extending transversely from the second vertical web in opposed vertically spaced relation;

said first vertical web having a length such that said first pair of track surfaces are spaced apart a distance corresponding to the diameter of the wheels of said first trolleys, and said second vertical web having a length such that said second pair of track surfaces are spaced apart a distance corresponding to the diameter of the wheels of said second trolley wheels;

and mounting means for supporting said pair of track members in a longitudinally parallel, transversely spaced relationship in which one of said first and second trackways of one of said track members faces the corresponding one of said first and second trackways of the other of said track members and in which the vertical webs of the other of said first and second trackways of said track members face each other, said facing trackways being unobstructed by said mounting means and forming said track engaged by and vertically supporting the wheels of one of said first or second trolleys, whereby said track members are capable of being assembled in any one of the following longitudinally parallel, transversely spaced relationships:

(a) said track is formed by said first trackways for the wheels of said first conveyor trolleys, and the vertical webs of said second trackways face each other and are disposed vertically below said track;

(b) said track is formed by said second trackways for the wheels of said second conveyor trolleys, and the vertical webs of said first trackways face each other and are disposed vertically below said track;

(c) said track is formed by said first trackways for the wheels of said first conveyor trollies, and the vertical webs of said second trackways face each other and are disposed vertically above said track; and (b) said track is formed by said second trackways for the wheels of said second conveyor trolleys, and the vertical webs of said first trackways face each other and are disposed vertically above said track.

9. A track according to claim 7 or 8 wherein the vertical extremities of each of the track members are defined by first and second terminal flanges which respectively extend transversely oppositely from the first and second vertical webs and which respectively form one of said first pair of track surfaces and one of said second pair of track surfaces, and wherein the mounting means comprises a plurality of longitudinally spaced yokes each connected to corresponding terminal flanges of the pair of track members and to at least a portion of the corresponding vertical webs from which said corresponding terminal flanges extend.

10. A track member according to claim 1 or 2 of integrally formed unitary construction.

* * * * *